US005630472A

United States Patent [19]

Potier

[11] Patent Number: 5,630,472

[45] Date of Patent: May 20, 1997

[54] HEAT EXCHANGER WITH A BUNDLE OF TUBES AND A METALLIC TUBE PLATE

[75] Inventor: Michel Potier, Rambouillet, France

[73] Assignee: Valeo Thermique Moteur, Le Mesnil-Saint-Denis, France

[21] Appl. No.: 544,096

[22] Filed: Oct. 17, 1995

[30] Foreign Application Priority Data

Oct. 19, 1994 [FR] France ..... 94 12491

[51] Int. Cl.[6] ..... F28D 1/00

[52] U.S. Cl. ..... 165/149; 165/67; 165/906

[58] Field of Search ..... 165/906, 149, 165/67

[56] References Cited

U.S. PATENT DOCUMENTS

| | | | |
|---|---|---|---|
| 2,932,489 | 4/1960 | Young | 165/149 |
| 4,230,176 | 10/1980 | Crews | 165/67 |
| 4,465,126 | 8/1984 | Winterer | 165/149 X |
| 4,534,407 | 8/1985 | Lardner | 165/149 X |
| 4,705,104 | 11/1987 | Potier | 165/149 |
| 5,186,239 | 2/1993 | Young et al. | 165/149 X |
| 5,355,944 | 10/1994 | Potier | 165/149 |

FOREIGN PATENT DOCUMENTS

| | | | |
|---|---|---|---|
| 307803 | 3/1989 | European Pat. Off. . | |
| 567401 | 10/1993 | European Pat. Off. . | |
| 2254771 | 12/1973 | France . | |
| 2273253 | 12/1975 | France . | |
| 2472734 | 7/1981 | France . | |
| 2639099 | 5/1990 | France . | |
| 8629407 | 1/1987 | Germany . | |
| 4288488 | 10/1992 | Japan | 165/67 |
| 1484510 | 11/1974 | United Kingdom . | |
| 2090958 | 7/1982 | United Kingdom . | |
| WO79/00967 | 11/1979 | WIPO . | |

*Primary Examiner*—John Rivell
*Assistant Examiner*—Christopher Atkinson
*Attorney, Agent, or Firm*—Morgan & Finnegan, L.L.P.

[57] ABSTRACT

A heat exchanger, in particular an engine cooling radiator for a motor vehicle, and especially one having a single row of tubes, comprises a bundle of tubes which are fitted sealingly in holes in a metallic tube plate, with a header being fitted over the tube plate. The heat exchanger also includes retaining plates which are formed integrally with the tube plate from a single press-formed sheet metal blank, the retaining plates then being bent over into their correct orientation. Each retaining plate extends parallel to the longitudinal direction of the tubes in the bundle, and is such as to engage against the edges of cooling fins of the tube bundle, thus preventing any movement, in pivoting or torsion, of the tube bundle with respect to the assembly consisting of the tube plate and the header.

4 Claims, 1 Drawing Sheet

Fig. 1
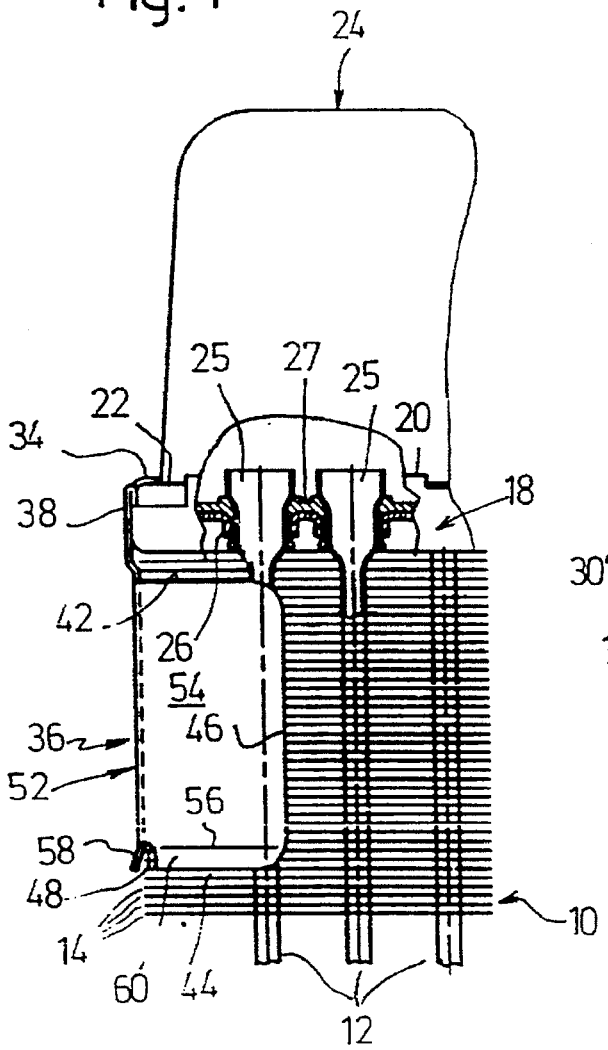
Fig. 2
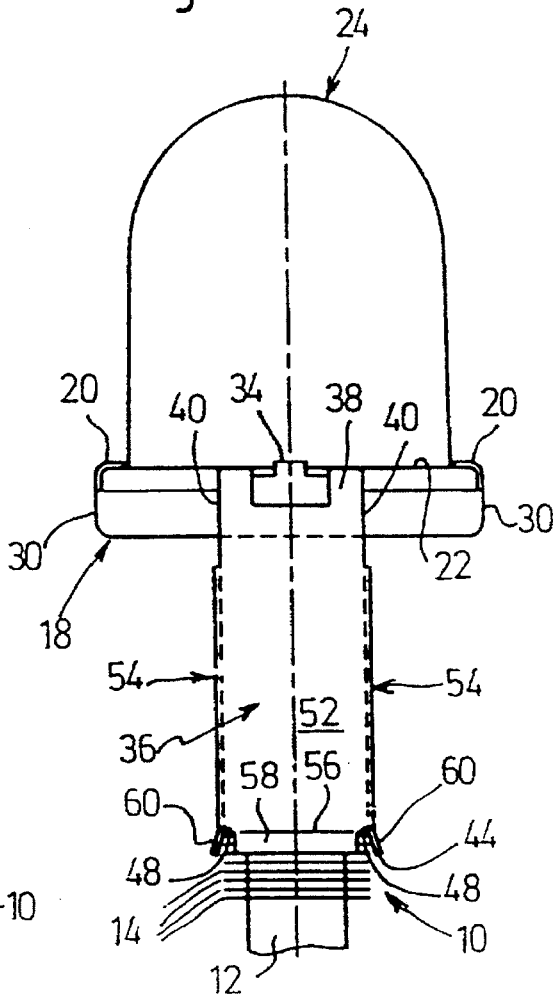
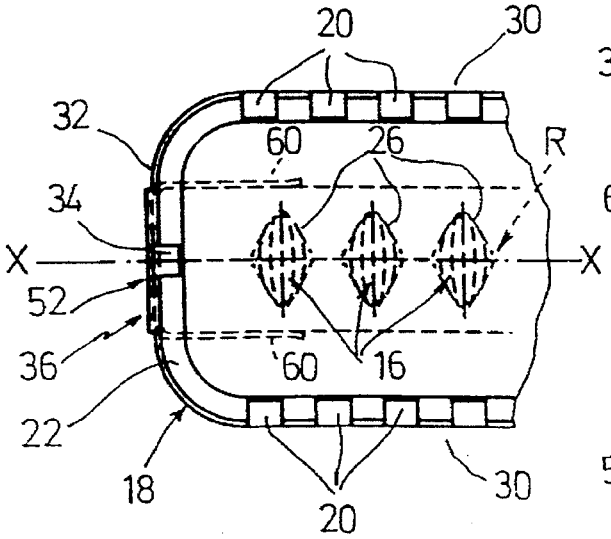
Fig. 3
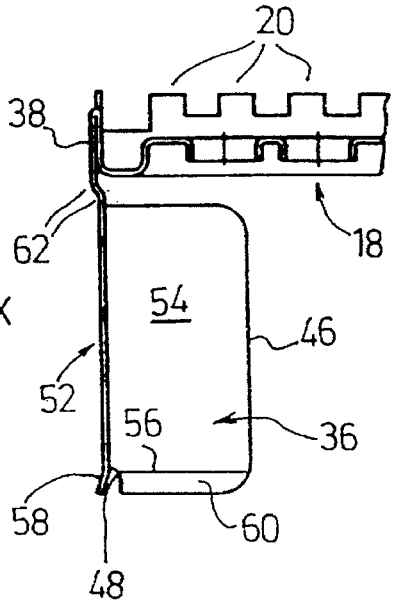
Fig. 4

HEAT EXCHANGER WITH A BUNDLE OF TUBES AND A METALLIC TUBE PLATE

FIELD OF THE INVENTION

This invention relates to a heat exchanger, especially for a motor vehicle, of the type comprising a bundle of tubes and a metallic tube plate, into which the ends of the tubes in the tube bundle are fitted sealingly into holes formed in the tube plate, with a header fitted over the tube plate. Such heat exchangers are intended most particularly to constitute cooling radiators for the engines of motor vehicles.

BACKGROUND OF THE INVENTION

Such a heat exchanger is assembled without any welding or soldering, sealing of the tubes to the tube plate being obtained by means of an elastomeric gasket. When such a heat exchanger is handled either before or during its assembly into a vehicle, or even after it has been fitted into the vehicle, it does happen in some cases that relative movements of the tube bundle, in particular in a pivoting mode or due to torsion, take place with respect to the assembly consisting of the tube plate and the header. Such relative movement may be caused by pressure and mechanical stresses transmitted to the headers through the mounting points of the heat exchanger. This pivoting or torsion effect is particularly critical when the tube bundle has only a single range of tubes.

In order to overcome this disadvantage, it is known to connect the two headers of a heat exchanger together by means of cross members which impart some rigidity to the assembly. However, a disadvantage of this arrangement is that it necessitates additional components, requires a header of special design, and calls for a specialized machine for seaming the cross members in place.

Other solutions have also been proposed for providing rigid connection between a bundle of tubes and an assembly consisting of a tube plate and a header. Thus for example, French patent No. 84 02964, published under the number 2 560 368, describes a heat exchanger which includes retaining means that cooperate with fins or the like carried by the tubes in the bundle. The purpose of these retaining plates is to resist any relative displacement, in particular in a pivoting or torsional mode, of the tube bundle with respect to the assembly consisting of the tube plate and the header. In this known heat exchanger, however, these retaining means consist of lugs which are formed by molding with the header, which makes it necessary again to provide specially designed headers.

DISCUSSION OF THE INVENTION

An object of the present invention is to provide an alternative solution to the problem discussed above.

According to the invention, a heat exchanger comprising a bundle of tubes and a metallic tube plate, in which the ends of the tubes are fitted sealingly into the holes in the heat exchanger on which a header is fixed, with the said heat exchanger further including retaining or immobilizing means which cooperate with fins or the like carried by the tubes in the bundle, whereby to oppose any relative displacement, in particular in pivoting or torsion, of the tube bundle with respect to the tube plate, is characterized in that the said retaining means comprise retaining plates, which are formed integrally with the metallic tube plate, and which are bent back so as to extend parallel to the direction of the tubes, the retaining plates engaging against the edges of fins in the tube bundle.

These retaining plates in accordance with the invention are thus part of the same component as the tube plate, and the assembly can easily be manufactured using conventional operations of blanking out, press-forming and bending of a sheet metal blank. It is then no longer necessary to provide specially designed headers.

In a preferred embodiment of the invention, the heat exchanger has two of these retaining plates, arranged at the longitudinal ends of the tube plate in such a way as to receive the longitudinal ends of some of the fins in the tube bundle.

According to a preferred feature of the invention, the retaining plates have a substantially U-shaped cross section.

Each of the retaining plates preferably comprises a spine portion of generally rectangular form which is joined to the tube plate through a tongue, together with two wing portions which are bent back at right angles with respect to the spine portion, with the spine portion coming into engagement against an end face of the tube bundle and the two wing portions engaging against two longitudinal faces of the tube bundle. In this way, the two U-shaped retaining plates are able to embrace the tube bundle at both of its longitudinal ends.

According to a further preferred feature of the invention, the bent retaining plates have some edges which are made slightly open, in order to facilitate fitting of the tube bundle and in order to avoid any damage to the fins of the latter.

The tube plate and the retaining plates are preferably formed from a sheet metal blank which has previously been press-formed. Thus, the retaining plates are initially formed in the same plane as the sheet metal blank, and are subsequently bent into their correct orientation with respect to the tube plate.

Further features and advantages of the invention will appear more clearly from the following detailed description of a preferred embodiment of the invention, which is given by way of example only and with reference to the accompanying drawings.

BRIEF DESCRIPTION OF THE DRAWINGS

FIG. 1 is a partial view in elevation, shown partly cut away and showing a heat exchanger in accordance with the invention.

FIG. 2 is a partial side view corresponding to FIG. 1.

FIG. 3 is a partial top plan view of the same heat exchanger.

FIG. 4 is a partial side view showing the tube plate in accordance with the invention.

DESCRIPTION OF A PREFERRED EMBODIMENT OF THE INVENTION

The heat exchanger, part of which is shown in FIGS. 1 to 3, comprises a bundle 10 consisting of a single row of tubes 12 which are aligned with each other, and which extend through a multiplicity of flat cooling fins 14. The fins 14 are parallel to each other and extend at right angles to the longitudinal direction of the tubes 12. The ends of the tubes 12 are fitted sealingly in the holes 16 (best seen in FIG. 3) in a tube plate 18, which is also referred to as a header or collector plate or a perforated plate. The tube plate 18 has a number of peripheral seaming lugs 20, which are bent back over the peripheral flange 22 of a header cover 24 (referred to herein as a header), which is of conventional type. In this example, the holes 16 in the tube plate 18 (see FIG. 3) are substantially elliptical, with the minor axes of the ellipses being aligned with each other and extending in the direction of the row R of the tubes 12. Each of the holes 16 is surrounded by a collar portion 26 of the tube plate, seen in FIGS. 1 and 3.

Sealing at the ends 25 of the tubes 12 is obtained by means of a gasket 27 of elastomeric material, seen in FIG. 1. This gasket covers one surface of the collector 18, and includes collar portions (not shown) which are trapped between the ends of the tubes 12 and the collar portions 26, again in a manner which is known per se.

The tube plate 18 is formed from a sheet metal blank. The tube plate 18 itself is generally rectangular in shape and has two longitudinal edges 30 which constitute the major sides of the rectangle and which extend parallel to an axis XX corresponding to the direction of the row R of tubes, while at the same time constituting an axis of symmetry. In addition, the tube plate 18 has two longitudinal ends 32 which constitute the minor sides of the rectangle. The seaming lugs 20 are formed essentially along each of the longitudinal edges 30.

The tube plate 18 further includes a seaming lug 34 which is formed by making an opening in the sheet metal blank at each of the longitudinal ends 32 of the tube plate 18 (again see FIGS. 1 to 3). The seaming lugs 20 and the seaming lugs 34 are arranged to be bent back against the peripheral edge 22 of the header 24 in a manner known per se.

The tube plate 18 is formed integrally, in one piece, with two retaining plates 36, which are formed in the sheet metal blank and which are attached to the tube plate 18 itself at its two longitudinal ends 32. Each of the retaining plates 36 is generally rectangular in form, and is attached to the corresponding end 32 of the tube plate by means of a generally rectangular tongue 38 having two side edges 40 (see FIG. 2) which extend parallel to the axis XX.

Each retaining plate 36 (FIG. 1) is bounded by a long side 42 which is joined to the tongue 38, arid another long side 44, and by two short sides 46 which lie symmetrically on either side of the axis XX. Two slots 48 are formed in the long side 44 symmetrically on either side of the axis XX, and form extensions of the side edges 40 of the tongue 38, as can be seen in FIGS. 1, 2 and 4. The retaining plate 36 comprises a central spine portion 52 which constitutes an extension of the tongues 38, together with two lateral wing portions 54 which are joined to the spine portion 52 on either side of the latter.

The slots 48 facilitate bending of the retaining plate 36 about a bending line 56 at right angles to the axis XX, so as to form a slightly open edge portion 58 which is joined to the spine portion 52 along the bending line 56, together with two further slightly open edge portions 60 which are joined, respectively, to the two wing portions 54 in the same way, as can be seen in FIGS. 1 to 4.

In the fabrication of a heat exchanger having the construction shown in the drawings, the starting point is at least one tube plate 18 formed by press-forming from a metallic blank. The latter is then embossed in such a way as to form a peripheral groove (not shown), which is arranged to receive subsequently the peripheral flange 22 of the header 24. The two wing portions 54 are bent at right angles with respect to the spine portion 52, thus giving a retaining plate 36 which is bent into a U-shaped cross section as can be seen in FIGS. 1 and 2. It should be noted that the edge portion 58 and the two edge portions 60, both of which are slightly open as mentioned above, have preferably been previously bent along the bending line 56, before the two wing portions 54 are bent back at right angles to the spine portion 52.

As is best seen in FIG. 4, the tongue 38 includes a cranked portion which is formed by bending about two adjacent bending lines 62 that extend parallel to each other and at right angles to the direction XX. This cranked portion enables the tongue 38 and the spine portion 52 to extend around the longitudinal end 32 of the tube plate 18, and then to come, below the cranked portion, as close as possible to the cooling fins 14 of the tube bundle.

Fabrication is completed by bending back each of the retaining plates 36 about an axis which extends at right angles to the axis XX, and which constitutes the junction between the end 32 of the tube plate 18 and the corresponding tongue 38. In this way, the retaining plate 36 is pivoted through about 90 degrees. The tube plate 18 is subsequently assembled in the usual way to the tube bundle 10, and the header 24 is then fitted.

The position which is obtained in this way corresponds to that which is shown in FIGS. 1 to 3, and in which each of the retaining plates 36 extends parallel to the direction of the tubes 12, so as to engage against the edges of some of the fins 14 of the tube bundle. In this position, the retaining plate 36, with its U-shape, embraces one longitudinal end of the tube bundle, with its spine portion 52 engaging against one end face of the tube bundle, and with the two wing portions 54 being in engagement against two longitudinal faces of the tube bundle. In this way, the tube bundle is fully immobilized against any pivoting or torsional movements with respect to the assembly consisting of the tube plate and the header.

It will be realized that the various operations involved in fabrication of a heat exchanger in accordance with the invention, for example as described above and shown in the drawings, are substantially identical to those of a heat exchanger in the prior art. It is only necessary simply to provide a particular tube plate formed from a sheet metal blank to which a certain number of mechanical pressing, forming and bending operations are applied, for example as described above.

Due to the fact that the tube bundle is fully immobilized with respect to the assembly consisting of the tube plate and the header, perfect sealing in the region of the ends of the tubes engaged in the holes in the tube plate can be obtained.

What is claimed is:

1. A heat exchanger comprising: a tube bundle including a plurality of tubes each having an end and a plurality of fins carried by said tubes, said fins having edges; a metallic tube plate having a plurality of holes, said ends of the tubes in the bundle being fitted sealingly into the holes in the tube plate; and a header fitted over the tube plate, wherein the heat exchanger further includes a retaining plate having a substantially U-shaped cross-section for cooperating with said fins and for resisting displacement of the tube bundle relative to the tube plate, said retaining plate being integral with the metallic tube plate and extending parallel to a longitudinal direction of the tubes so as to engage against the edges of said fins; said retaining plate including a generally rectangular spine portion, a tongue joining said spine portion to said tube plate, two wing portions joined to the spine portion and bent back at right angles with respect to said spine portion, said spine portion engaging a first end of the tube bundle and said two wing portions engaging respectively against two longitudinal sides of said tube bundle, and edge portions joined to said spine portion and said wing portions, said edge portions being slightly opened so as to avoid damage to the fins.

2. A heat exchanger according to claim 1, wherein said tube plate has a first longitudinal end and a second longitudinal end, said retaining plate being formed at said first longitudinal end, and wherein the heat exchanger further comprises a second retaining plate formed at said second longitudinal end, said second retaining plate having a second spine portion engaging a second end of the tube bundle.

3. A heat exchanger according to claim 1, wherein the tube plate and the retaining plate are formed from a single press-formed metallic sheet metal blank.

4. A heat exchanger according to claim 3, wherein the retaining plate is initially in the same plane as the sheet metal blank, and is then bent down into position.

* * * * *